US005808257A

United States Patent [19]

Thuries

[11] Patent Number: 5,808,257

[45] Date of Patent: Sep. 15, 1998

[54] HIGH-VOLTAGE GAS-BLAST CIRCUIT-BREAKER

[75] Inventor: Edmond Thuries, Pusignan-Meyzieu, France

[73] Assignee: GEC Alsthom T & D SA, Paris, France

[21] Appl. No.: 898,127

[22] Filed: Jul. 22, 1997

[30] Foreign Application Priority Data

Jul. 23, 1996 [FR] France ..... 96 09212

[51] Int. Cl.[6] ..... H01H 33/88

[52] U.S. Cl. ..... 218/60; 218/66; 218/59

[58] Field of Search ..... 218/43, 51, 52, 218/56, 57, 59, 60, 61, 66, 47

[56] References Cited

U.S. PATENT DOCUMENTS 4,475,018 10/1984 Arimoto et al. ..... 200/148 R

FOREIGN PATENT DOCUMENTS

0175954A2 4/1986 European Pat. Off. .
0475270A2 3/1992 European Pat. Off. .
2264380 10/1975 France .

*Primary Examiner*—Renee S. Luebke
*Assistant Examiner*—Michael J. Hayes
*Attorney, Agent, or Firm*—Sughrue, Mion, Zinn, Macpeak & Seas, PLLC

[57] ABSTRACT

A gas-blast gas-insulated high-voltage circuit-breaker comprises a fixed main contact, a fixed arc contact and a mobile assembly comprising a main contact, an arc contact and a compression volume cooperating with a fixed piston and communicating with a blast volume leading to a blast nozzle. The compression volume is provided with a valve preventing the gas passing from the blast volume to the compression volume. The piston comprises openings for evacuating the gas from the compression volume during tripping, these openings being closed between the start of compression of the compression volume and the closure of the valve and open upon closure of the valve.

4 Claims, 2 Drawing Sheets

HIGH-VOLTAGE GAS-BLAST CIRCUIT-BREAKER

BACKGROUND OF THE INVENTION

Field of the Invention

The present invention concerns a high-voltage gas-blast circuit-breaker.

A circuit-breaker of this kind is described in European patent application N° 0 475 270, for example.

The circuit-breaker comprises, for each phase, an insulative jacket filled with gas having good dielectric properties such as sulfur hexafluoride SF6, at a pressure of a few thousand hectopascals.

Within the envelope is a fixed assembly comprising fixed main contacts through which the permanent current passes and arc contacts.

There is also a mobile assembly actuated by an operating mechanism and comprising mobile main contacts and arc contacts; the mobile assembly comprises two communicating volumes, a compression volume cooperating with a fixed piston and a blast volume leading into a blast nozzle. A valve in the blast volume prevents the gases flowing back into the compression volume. A circuit-breaker of this kind operates in the following manner.

On the occurrence of a fault, an instruction is given to the operating mechanism which drives the mobile assembly. The gas in the compression volume and the blast volume is compressed by the relative displacement of the mobile assembly and the fixed piston.

When the arc contacts separate an arc is struck which heats the gas; the pressure in the blast volume increases very greatly and closes the valve. On the first zero crossing of the current the gas in the blast volume expands and blows out the arc.

During the time period between the closing of the valve and the blowing out of the arc, the mobile assembly continues to move and as a result the gas in the compression volume is compressed more and more. This supplementary compression is not only of no utility, since the compression volume is closed and the gas it contains does not contribute to the blast, but prejudicial in that it requires energy that is necessarily taken from the operating mechanism, which must be dimensioned accordingly. The increase in the pressure in the compression volume should therefore cease as soon as the valve closes.

In the aforementioned document, this problem is solved by making the piston semi-mobile and enabling it to move against the action of calibrated springs in the same direction as the mobile assembly during the operation of tripping the circuit-breaker.

This solution is costly because it requires springs and means of calibrating the springs.

A similar solution is described in the document U.S. Pat. No. 3,975,602. A similar solution using calibrated valves is described in the document U.S. Pat. No. 4,658,108.

An aim of the present invention is to provide a circuit-breaker in which the increase in pressure is stopped by simple means.

SUMMARY OF THE INVENTION

In accordance with the invention, the gas is evacuated from the compression volume by means of openings in the blast piston, the openings being associated with means for maintaining them closed between the start of the compression of the compression volume and the closure of the valve and opening them upon closure of the valve, the means comprising fixed rods sliding in the openings of the piston, these rods having longitudinal recesses or notches or grooves or splines over a portion of their length such that the recessed part of the rods is in the openings when the valve closes.

In a preferred embodiment, the rods are so disposed that their greater part is inside the compression volume when the circuit-breaker is in the engaged position.

Alternatively, the rods are so disposed that their greater part is outside the compression volume when the circuit-breaker is in the engaged position.

A cylinder carrying the mobile arc contacts comprises notches or splines or grooves or recesses cooperating with the piston to evacuate the compression gas at the end of compression.

The invention will be clearly understood upon reading the description of two embodiments of the invention given hereinafter with reference to the accompanying drawings.

DETAILED DESCRIPTION OF THE PREFERRED EMBODIMENTS

Figure 1:
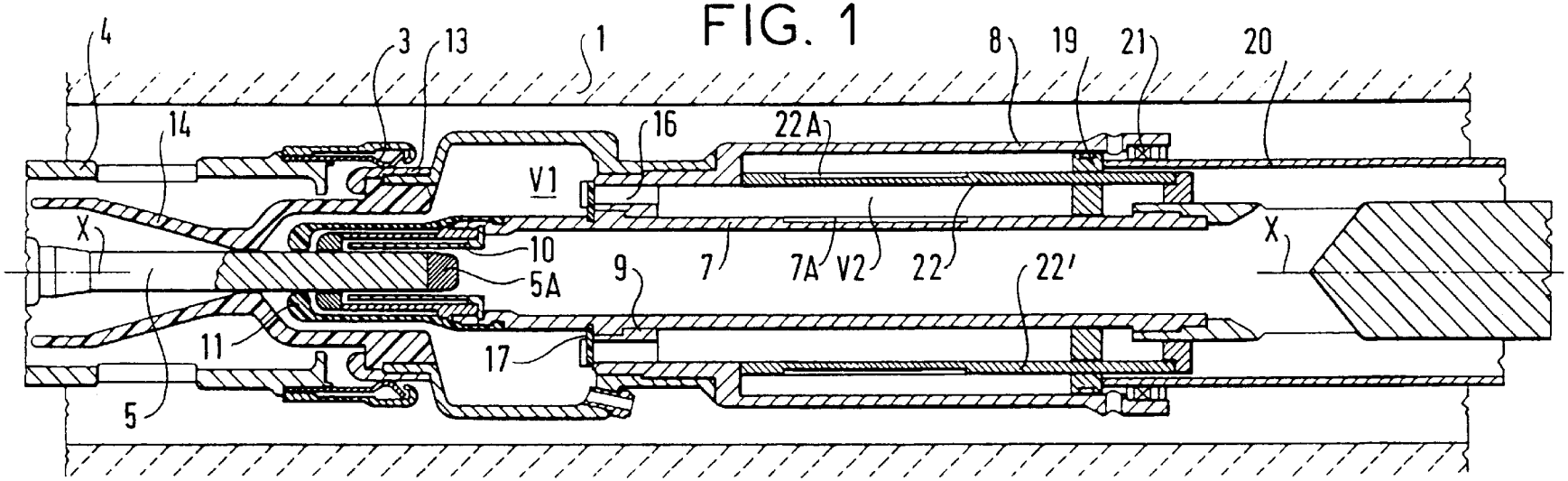
FIG. 1 is a fragmentary view in axial section of an interrupter chamber of a circuit-breaker shown in the engaged position.

FIG. 1 shows an insulative, for example ceramic, jacket 1 of cylindrical shape with an axis xx and having fins such as the fin 2.

The jacket contains a gas having good dielectric properties, such as sulfur hexafluoride SF6, at a pressure of a few thousand hectopascals.

Inside the jacket is a fixed assembly comprising a ring of contact fingers 3 through which the permanent current passes and disposed at the end of a metal tube 4 and a metal rod 5 constituting the fixed arc contact and the end of which is made from an alloy that is resistant to the effects of the arc. The tube 4 and the rod 5 are connected to a first terminal of the circuit-breaker, not shown.

The chamber also contains a mobile assembly essentially comprising two coaxial substantially cylindrical metal parts 7 and 8 mechanically fastened together by a transverse ring 9. A first end of the inner cylinder 7 (on the right in the figure) is mechanically coupled to an operating mechanism, not shown; the second end of the cylinder 7 carries a ring of contact fingers 10 protected by a discharge preventer cap 11. These contact fingers constitute the mobile arc contact and cooperate with the rod 5–5A.

The cylinder 8 carries at a first end (on the left in FIG. 1) a cylinder 13 cooperating with the fingers 3 to pass the permanent current.

The cylinders 7 and 8 and the ring 9 define two volumes V1 and V2 respectively designated the blast volume and the compression volume. The blast volume V1 opens into a blast nozzle 14 fixed to the first end of the tube 8. The blast volume V1 communicates with the compression volume V2 via openings 16 in the ring 9; these openings can be obstructed by an annular valve 17 adapted to prevent the gas passing from the blast volume to the compression volume.

The compression volume V2 is closed at the end opposite the ring 9 by a fixed annular piston 19 at the end of a fixed metal tubular part 20. The end of the part 20 opposite that carrying the piston 19 is electrically connected to a second terminal, not shown. The cylinder 8 is provided with sliding electrical contacts 21, of the concertina type, for example, to pass the current from the tube 8 to the tubular part 20.

Figure 3:
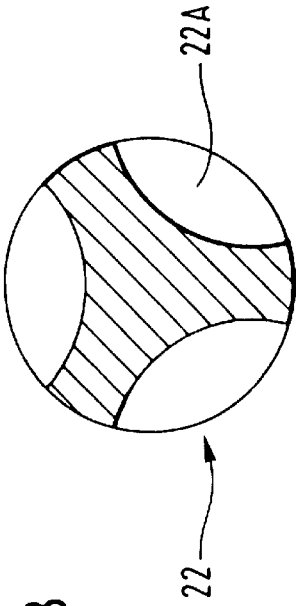
FIG. 3 is a sectional view of a rod of the circuit-breaker.

Inside the compression volume V2 there are a plurality of metal rods 22 parallel to the axis of the jacket, fixed at one end to the end of the cylinder 7 adjoining the ring 9 and passing through openings in the piston 19. Over part of their length these rods have transverse recesses or grooves or notches or splines 22A, of which there are three, for example, as shown in FIG. 3, which is a cross-sectional view of a rod 22 in the area with the grooves.

The cylinder 7 can also have axial rectilinear grooves or notches or splines 7A on its outside periphery, disposed like the recesses or notches or grooves or splines 22A.

The circuit-breaker operates in the following manner.

In the engaged position, the current flows from the first terminal to the second via the tube 4, the fingers 3, the cylinder 13, the cylinder 7, the sliding contact 21 and the tube 20, in succession.

When the circuit-breaker is tripped, the mobile assembly is drawn towards the right in FIG. 1. The main contacts 3 and 13 separate and the current is switched to the arc contacts. The piston compresses the gas in the volumes V1 and V2.

When the arc contacts 5–5A and 10 separate an arc is struck and heats the gas in the volume V1. The valve 17 closes.

At this stage in the movement of the mobile assembly it is no longer necessary to compress the volume V2 and this is why the invention evacuates the gas from this volume.

Figure 2:
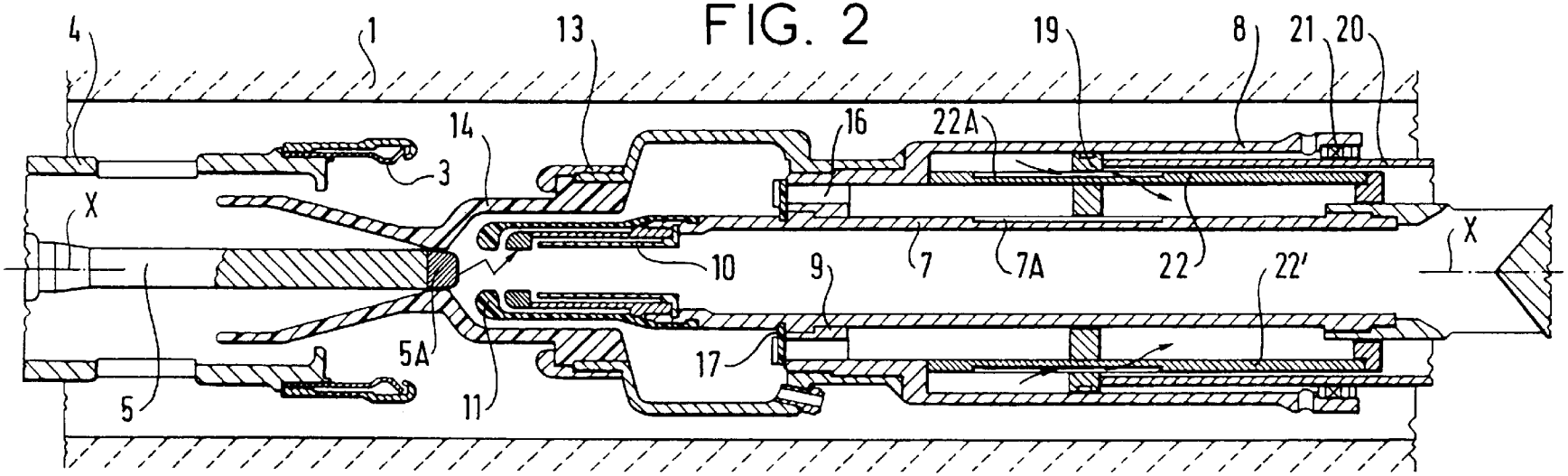
FIG. 2 is a fragmentary view in axial section of the same interrupter chamber, shown during tripping.

The notches in the rods 22 and those in the cylinder 7 reach the openings in the piston (FIG. 2) with the result that the gas can escape from the volume V1 without requiring any compression energy.

On the first zero crossing of the current the gas from the volume V1 expands and blows out the arc.

Figure 4:
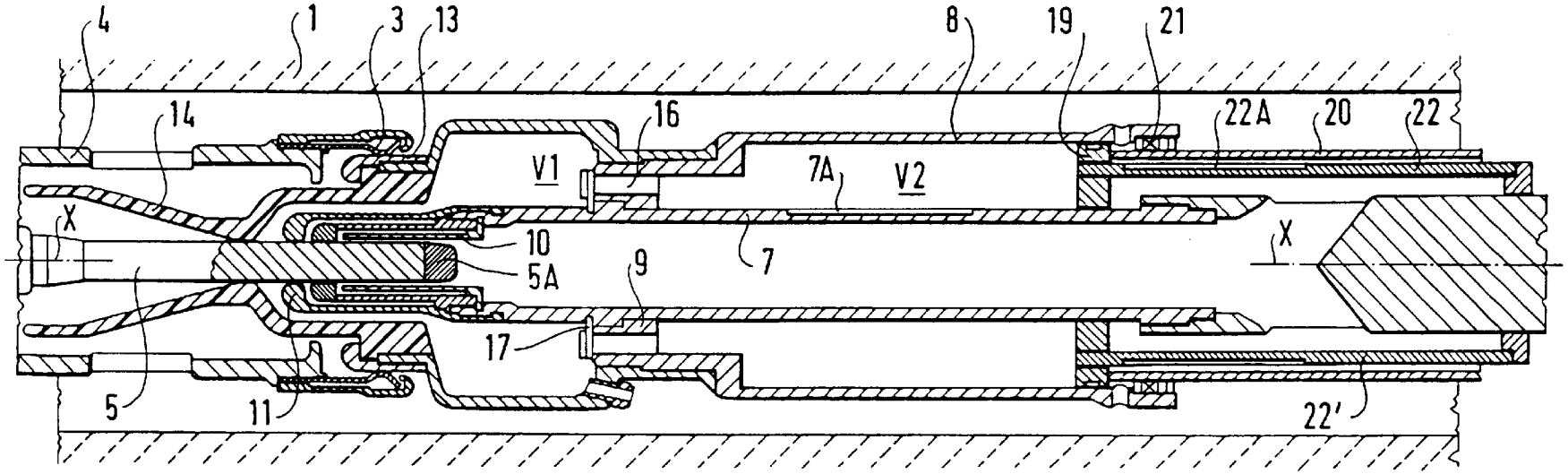
FIG. 4 is a fragmentary view in axial section of a different embodiment of interrupter chamber, shown in the engaged position.

FIG. 4 shows a different embodiment of the invention in which the notched rods 22' are outside the compression volume. Operation is exactly the same as previously described.

The solution of the invention is simple and applies equally well to "open" type conjunctors and to grounded metal jacket ("metal-clad") type circuit-breakers.

There is claimed:

1. A gas-blast gas-insulated high-voltage circuit-breaker comprising a fixed main contact, a fixed arc contact and a mobile assembly comprising a main contact, an arc contact and a compression volume cooperating with a fixed piston and communicating with a blast volume leading to a blast nozzle, said compression volume being provided with a valve preventing said gas passing from said blast volume to said compression volume, wherein said piston includes openings enabling said gas to be evacuated from said compression chamber during a tripping operation, said openings being associated with means for maintaining them closed between the start of said compression of said compression volume and the closure of the valve and opening them upon closure of said valve, said means comprising fixed rods sliding in said openings of said piston, said rods having longitudinal recesses or notches or grooves or splines over a portion of their length such that the recessed part of said rods is in said openings when said valve closes.

2. The circuit-breaker claimed in claim 1 wherein said rods are so disposed that their greater part is inside said compression volume when said circuit-breaker is in the engaged position.

3. The circuit-breaker claimed in claim 1 wherein said rods are so disposed that their greater part is outside said compression volume when said circuit-breaker is in the engaged position.

4. A circuit-breaker as claimed in claim 1 including a cylinder carrying said mobile arc contacts and comprising notches or splines or grooves or recesses cooperating with said piston to evacuate said compression gas at the end of compression.

* * * * *